US005423500A

United States Patent [19]

Struthers et al.

[11] Patent Number: 5,423,500

[45] Date of Patent: Jun. 13, 1995

[54] FLAT BRACKET FOR WALL MOUNT SPEAKERS

[75] Inventors: Scott Struthers; William J. Kindel, both of San Clemente; Geoffrey L. Spencer, Laguna Niguel; F. Hendrik Huebscher, Mission Viejo; Ronald Maurer, El Cajon, all of Calif.

[73] Assignee: Dana Innovatins, San Clemente, Calif.

[21] Appl. No.: 88,155

[22] Filed: Jul. 6, 1993

[51] Int. Cl.[6] ..... G12B 9/00

[52] U.S. Cl. ..... 248/27.1; 181/150

[58] Field of Search ..... 248/27.1, 27.3, 906; 381/24, 205; 181/150, 199

[56] References Cited

U.S. PATENT DOCUMENTS

| | | | |
|---|---|---|---|
| 2,522,859 | 9/1950 | Carbonneau | 179/115 |
| 2,604,285 | 7/1952 | Knoch | 248/27 |
| 3,180,595 | 4/1965 | Brunsting et al. | 248/27 |
| 3,327,984 | 6/1967 | Rennie | 248/343 |
| 3,369,784 | 2/1968 | Whitney | 248/27 |
| 3,664,615 | 5/1972 | Kruger | 248/27 |
| 3,727,004 | 4/1973 | Bose | 179/1 |
| 3,912,865 | 10/1975 | Seebinger | 179/1 |
| 4,133,975 | 1/1979 | Barker, III | 179/1 |
| 4,250,540 | 2/1981 | Kristofek | 362/368 |
| 4,266,092 | 5/1981 | Barker, III | 179/1 |
| 4,296,280 | 10/1981 | Richie | 181/150 X |
| 4,336,575 | 6/1982 | Gilman | 248/27.1 X |
| 4,439,643 | 3/1984 | Schweizer | 179/146 |
| 4,444,369 | 4/1984 | Job | 248/27 |
| 4,546,850 | 10/1985 | Litner | 181/141 |
| 4,555,080 | 11/1985 | Nara | 248/27.1 |
| 4,614,374 | 9/1986 | Lannert et al. | 292/337 |
| 4,688,596 | 8/1987 | Liebmann et al. | 137/360 |
| 4,727,587 | 2/1988 | Black | 381/188 |
| 4,760,510 | 7/1988 | Lahti | 362/365 |
| 4,778,134 | 10/1988 | Struthers et al. | 248/27 |
| 4,815,558 | 3/1989 | Krainhofer | 181/141 |
| 4,853,966 | 8/1989 | Skrzycki | 381/188 |
| 4,891,842 | 1/1990 | Green | 181/150 X |
| 4,903,300 | 2/1990 | Polk | 381/24 |
| 4,923,032 | 5/1990 | Nuernberger | 381/205 |
| 4,961,226 | 10/1990 | Saffran | 381/24 |
| 5,027,403 | 6/1991 | Short et al. | 381/24 |
| 5,082,083 | 1/1992 | Draffen | 181/150 |
| 5,088,574 | 2/1992 | Kertesz, III | 181/150 |
| 5,143,339 | 9/1992 | Ashcraft et al. | 248/343 |
| 5,205,755 | 4/1993 | Douty et al. | 439/247 |
| 5,206,464 | 4/1993 | Lamm | 181/199 X |
| 5,221,069 | 6/1993 | Struthers et al. | 248/231 |
| 5,310,149 | 5/1994 | Struthers | 181/150 X |
| 5,322,979 | 6/1994 | Cassity | 181/150 |

OTHER PUBLICATIONS

Designer Series Boston Acoustics.

*Primary Examiner*—J. Franklin Foss

*Attorney, Agent, or Firm*—Stetina Brunda & Buyan

[57] ABSTRACT

A bracket for the in-wall mounting of speakers has a bracket frame member in which a plurality of apertures are formed for receiving fasteners to attach at least one speaker thereto and also has a plurality of wing members formed upon the bracket frame member for attaching the frame member to a wall. The wing members are formed having a thickness of less than 0.040 inch to facilitate attachment to the wall intermediate a wall frame and wallboard such that bowing of the wallboard is mitigated. The frame member and wing members are preferably integrally formed of plastic.

30 Claims, 3 Drawing Sheets

FLAT BRACKET FOR WALL MOUNT SPEAKERS

FIELD OF THE INVENTION

The present invention relates generally to brackets and templates for mounting components within frame and wallboard construction walls and ceilings. It relates more particularly to a flat bracket and template for the in-wall mounting of speakers and the like.

BACKGROUND OF THE INVENTION

The demand for high-quality speakers has increased dramatically over the last twenty years. As a consequence, there is a large selection of high-quality speakers available on the market. Unfortunately, speakers are somewhat bulky and cumbersome. There has also been a demand to mount speakers in ceilings and walls. The mounting of high-quality speakers in a ceiling or wall is an expensive enterprise, particularly since mounting brackets must be custom made, and additionally because considerable effort is frequently required in the mounting of such brackets.

Prior art brackets which utilize wing members for attaching the bracket to the wall frame members or studs are known. Such brackets are typically utilized during new construction installations wherein the wall frame members are exposed, thus facilitating attachment of the bracket thereto. The wing members of such brackets are attached to the frame members via fasteners such as nails, screws, staples, etc. One such prior art bracket is disclosed in U.S. Pat. No. 4,778,134 issued on Oct. 18, 1988 to Struthers et al., the contents of which are hereby incorporated by reference.

However, the use of prior art brackets which incorporate such wing members requires that the frame members or studs to which the wing members are attached be notched or mortised to accommodate the thickness of the wing members such that the wallboard applied thereover does not bulge or bow outwardly due to the thickness of the wing members which are disposed intermediate the wall frame members and the wallboard. It has been found that even with wing members as thin as 1/16 inch (0.0625 inch) that sufficient bowing of the wallboard occurs so as to be objectionable.

Additionally, such prior art brackets must be installed prior to application of a wall covering over the wall frame members, and as such are suitable for new construction use only. Such prior art brackets are not practical for use in retrofit installations, since such use would require that a substantial portion of the wallboard be removed from the wall frame members to provide access to the wall frame members such that the wings of the bracket may be attached thereto.

Furthermore, templates for positioning items such as speakers which are to be mounted into a wall are well known. Such templates typically comprise a sheet of paper having indicia formed thereon to indicate the size and position of a cutout to be made in the wallboard as well as any other apertures necessary for mounting hardware, i.e., screws, bolts, etc. Such prior art templates are typically taped to the wall such that the indicia representative of the opening to be formed in the wall is positioned as desired. Next, a hole is cut in the wallboard by tracing the indicia representative of the cutout with a cutting tool.

However, such prior art templates do not aid in the positioning of the speaker or other device within the wall after the opening in the wallboard has been formed.

As such, it would be desirable to provide a bracket for the in-wall mounting of speakers which does not require that the wall frame members be mortised and which does not consequently result in bowing of the wallboard.

Additionally, it would be desirable to provide such a bracket which is suitable for use in prior construction or retrofit applications wherein the bracket could be installed by inserting it through a small opening formed in the wallboard, thus eliminating the requirement that a substantial portion of the wallboard be removed.

Furthermore, it would be desirable to provide a template which may be attached to frame and wallboard construction walls and ceilings within an opening which has been formed therein so as to facilitate the mounting of speakers and the like. Such a template should be permanently affixed within the wall or ceiling to serve as a guide for the mounting of speakers and the like. The template may also function as a "mud dam", thus providing a seal between the mounted device and the wallboard.

SUMMARY OF THE INVENTION

The present invention specifically addresses and alleviates the above-mentioned deficiencies associated with the prior art. More particularly, the present invention comprises a flat bracket or template for in-wall mounting of speakers. Although referred to herein as a bracket, those skilled in the art will recognize that the present invention is equally suited for use as a template. Thus, reference to the present invention as a bracket is not by way of limitation, but rather is meant to encompass use of the present invention as a template as well.

The flat bracket has a bracket frame member in which a plurality of apertures are formed for receiving fasteners to attach at least one speaker thereto and also having a plurality of wing members formed upon the bracket frame member for attaching the bracket frame member to a wall, i.e., to the studs of the wall frame.

A central opening formed within the bracket frame member receives the speaker or speaker assembly and optionally has a perpendicularly extending lip formed thereabout for strength.

Generally, fasteners such as self threading screws will be utilized to attach a speaker or assembly of speakers to the bracket frame member by passing the self threading screws through the housing or mounting frame of the speaker or speaker assembly and into the apertures of the flat bracket's frame member. Those skilled in the art will recognize that various other means of attachment are likewise suitable.

The bracket frame member and wing members are formed having a thickness of less than 0.040 inch, preferably approximately 0.020 inch, to facilitate attachment to a wall or ceiling intermediate a wall frame and wallboard such that bowing of the wallboard is thereby mitigated. The bracket frame member and wing members of the flat bracket are preferably integrally formed of a plastic material such as styrene. The bracket frame member is preferably generally rectangular in shape to accommodate popular speaker configurations, however those skilled in the art will recognize that various other shapes, i.e., round, oval, hexagonal, etc., are likewise suitable, Corrugations are optionally formed in the wing members to increase the structural strength thereof. Similar corrugations may optionally be formed within the bracket frame member to likewise increase the structural strength thereof. The corrugations are configured to flatten out when compressed intermediate the frame and the wallboard.

Apertures formed within the wing members facilitate mounting thereof to the wall frame members, i.e., typically 2×4 studs. Alternatively, pimples, bumps, or dimples may be utilized rather than apertures. Such pimples, bumps, or dimples do not actually penetrate the wing members, but rather merely deform them. In a first embodiment of the flat bracket for wall mount speakers of the present invention, two wing members are formed such that they extend from opposite sides of the bracket frame member. In a second embodiment of the present invention, two wing members are formed such that they extend perpendicularly from adjacent sides of a rectangular bracket frame member. Four wing members, one extending from each of the four sides of a rectangular bracket frame may be optionally utilized. Indeed, any desired number of wing members may be utilized to provide attachment of the flat bracket to a wall frame. In any case, the wing members are preferably configured to accommodate standard, i.e., 16 inch, spacing of the wall frame members.

Extensions may optionally be attached, preferably via ultrasonic welding, to the wing members to accommodate mounting of the flat bracket intermediate wall frame members or studs having non-standard or increased, i.e., 24 inch, spacing.

The flat bracket of the present invention may be utilized to mount speakers in walls, ceilings, and various other architectural structures. As used herein, the term wall encompasses all such structures.

The flat bracket is preferably formed by first die cutting the bracket frame member and wing members, preferably as an integral unit, from a sheet material, preferably styrene, having a thickness less that 0.040 inch, preferably approximately 0.020 inch. The sheet material is preferably similar to that utilized in the manufacture of credit cards for bracket applications and similar to that used in blister packs for template applications. The apertures formed in the bracket frame members and the apertures formed in the wing members are preferably die cut into the bracket as well. Those skilled in the art will recognize that various other means for forming such apertures are likewise suitable. Corrugations are formed in the wing members, preferably via vacuum forming, pressure forming, and/or thermal forming. Corrugations may optionally be similarly formed in the bracket frame member as well.

The optional lip may be formed to extend about the periphery of the central opening of the bracket frame member via vacuum forming, pressure forming, and/or thermal forming.

The flat bracket for wall mount speakers of the present invention facilitates mounting of a speaker or speaker assembly within a wall or ceiling by first attaching the bracket to wall frame members, i.e., 2×4 studs, at the desired location. This is accomplished by using nails or other suitable fasteners, i.e., wood screws, staples, etc., to attach the wing members to the wall frame members. The optional apertures formed within the wing members both serve as a means for positioning the fasteners relative to the wing members and for providing a visual indication of the location of the wall frame members disposed there beneath during the attachment process.

Because of the thin construction of the wing members, fasteners, i.e., nails, screws, staples, etc., can easily be applied therethrough at positions other than through the apertures formed therein. Additionally, the thin configuration of the wing members eliminates the need to notch or mortise the studs prior to attaching the wing members thereto.

An opening is formed in the wallboard such that when the wallboard is applied over the wall frame members, the opening corresponds generally in configuration and position to the opening in the bracket frame member. After applying the wallboard to the wall frame members, a speaker or speaker assembly is attached to the bracket by passing fasteners, i.e., self threading screws, through the speaker or speaker assembly mounting frame into the apertures formed in the flat bracket frame. As the fasteners enter the apertures of the flat bracket frame, they engage the bracket frame member and pull the speaker or speaker assembly into the opening formed in the wallboard, thus providing secure attachment of the speaker or speaker assembly to the wall.

The opening in the wallboard is preferably formed prior to attachment of the wallboard to the wall frame members. Bow ever, the opening in the wallboard may optionally be formed after attachment of the wallboard to the wall frame members by forming a small opening within the area in which the larger opening is to be formed and then carefully enlarging the small opening until it corresponds generally in configuration and position to the opening in the bracket frame member.

Although the present invention is described herein as being utilized for the mounting of speakers, such use is by way of example only and not by way of limitation. Those skilled in the art will recognize that the present invention may by utilized to mount various articles in walls and ceilings.

Because the bracket of the present invention is formed to be very thin or flat, it may also be utilized in prior construction or retrofit installations wherein an opening is formed in the wallboard at the desired location of the wall mount speaker. The opening need only be sufficiently large to receive the wall mount speaker. The flat bracket of the present invention is inserted through the opening and manipulated such that the wings thereof are disposed intermediate the wall covering and wall frame members adjacent the opening. The wings of the flat bracket of the present invention are sufficiently thin that they may be forced intermediate the wallboard and wall frame members, thus being securely captured and held therebetween in order to facilitate further installation according to the method utilized in new construction installations as described above.

The present invention may be used as a template for positioning of speakers and the like, rather than as a bracket to which they are attached. To use the present invention as a template, it is first attached to the wall, intermediate the studs and wallboard as when it is utilized as a bracket. The opening of the template then serves as a guide for mounting speakers and the like. That is, the opening of the template is oriented and positioned such that speakers and the like received thereby will be similarly positioned as desired. As such, in using the present invention as a template rather than a bracket, speakers and the like are merely inserted therein without being attached thereto. Other means are then utilized for actually securing the speakers or the like to the wall.

These, as well as other advantages of the present invention will be more apparent from the followings description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The flat bracket for wall mount speakers is illustrated in FIGS. 1–4 which depict two presently preferred embodiments of the invention.

Figure 1:
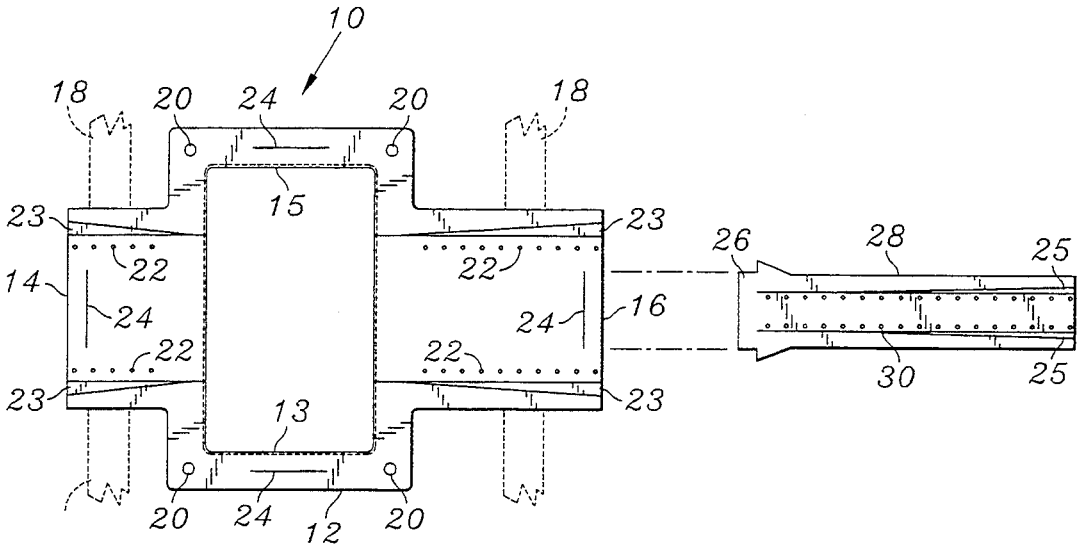
FIG. 1 is a top plan view of a first embodiment of the flat bracket for wall mount speakers of the present invention, illustrating attachment of an optional wing extension thereto, and also showing two studs or wall frame members phantom.
Figure 2:
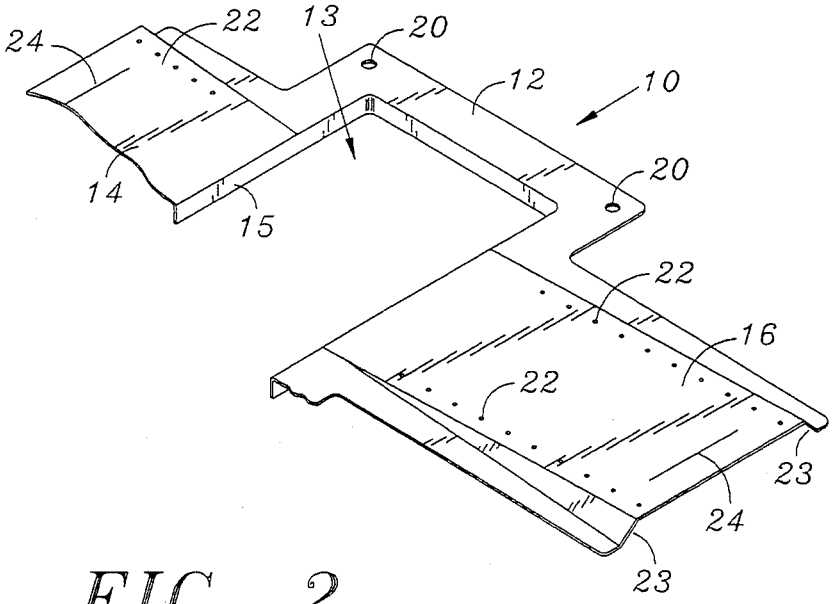
FIG. 2 is a sectional perspective view of the flat bracket of FIG. 1.

Referring now to FIGS. 1 and 2, the first embodiment of the flat bracket 10 is comprised generally of a bracket frame member 12 and first 14 and second 16 wing members attached thereto, preferably as integral portions thereof. The lengths of the first 14 and second 16 wing members may optionally differ so as to optimize flexibility in positioning of the bracket frame member 12 intermediate studs or wall frame members 18 during the installation process.

The bracket frame member 12 comprises a plurality of apertures 20 formed therein to facilitate the attachment of a speaker or speaker assembly (not shown) thereto. Those skilled in the art will recognize that various numbers and configurations of such aperture 20 formed in the bracket frame member 12 are likewise suitable.

The apertures 20 are only required in the bracket application of the present invention and not in the template application thereof. The use of the the apertures 20 to attach a speaker or speaker assembly to the bracket frame member 12 necessitates that holes be formed through the wallboard such that fasteners may pass therethrough. In the template application of the present invention, the speaker or speaker assembly does not have to attach to the template, therefore such apertures are not required.

A central opening 13 is formed within the bracket frame member 12. Lip 15 extends perpendicularly from the bracket frame member 12 about the periphery of central opening 13, thereby increasing the structural strength of the bracket frame member 12. The speaker or speaker assembly is attached to the bracket frame member 12 after wallboard (not shown) is applied thereover during the installation process as discussed in further detail below.

Apertures 22 formed in the first 14 and second 16 wing members facilitate attachment of the flat bracket 10 to the wall frame members 18. Slots 24 receive complementary tabs 26 formed in optional extensions 28 to facilitate attachment of the optional extensions 28 thereto such that non-standard spacing, i.e., 24 inch, etc., of the wall frame members 18 may be accommodated thereby. Apertures 30 formed in the extensions 28 facilitate attachment of the extensions 28 to the wall frame members 18 in a manner like that of the apertures 22 formed in the first 14 and second 16 wings. After inserting the tab 26 of the extension 28 into the slot 24 of the first 14 or second 16 wing, the extension 28 is preferably ultrasonically welded to the flat bracket 10. Those skilled in the art will recognize that various other means, i.e., adhesive bonding, etc., are likewise suitable for attaching an extension 28 to a wing member 14 or 16 of the flat speaker bracket.

Corrugations 23 are optionally formed in the first 14 and second 16 wings and similar corrugations 25 are likewise formed in the extension 26 to improve the structural strength thereof. As those skilled in the art will recognize, corrugations may also be formed within the bracket frame member 12 to similarly improve the structural strength thereof.

Figure 3:
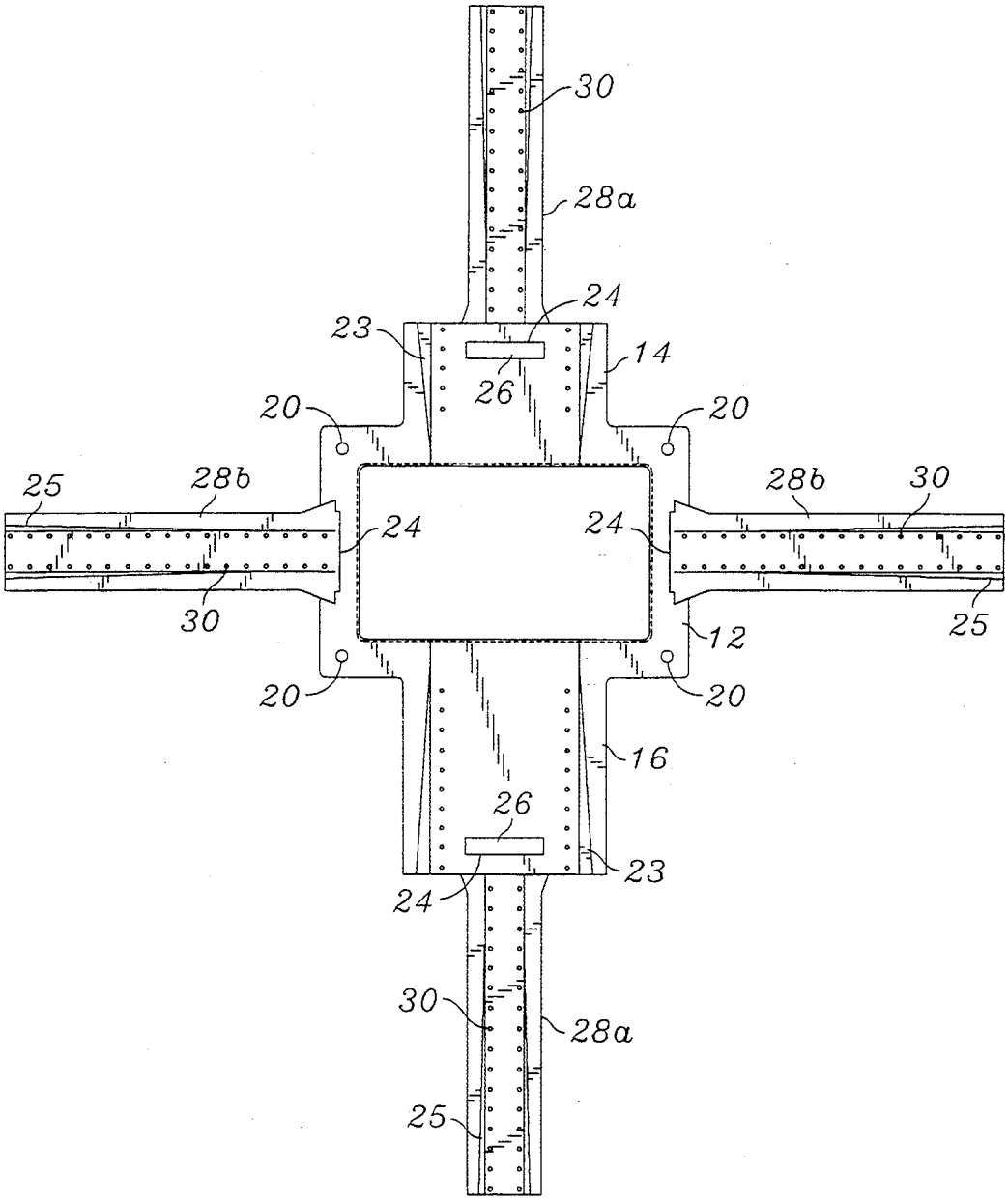
FIG. 3 is a top plan view of an alternative configuration of the flat bracket for wall mount speakers of the present invention wherein four extensions are attached thereto.

Referring now to FIG. 3, a flat bracket having four extensions 28 attached thereto is illustrated. The tabs 26 of the upper and lower extensions **28*a* pass through the slots 24 formed in the first 14 and second 16 wings from the rear surface thereof such that they are visible upon the upper surface. The tabs (not shown) of the left and right extensions 28*b* pass through the slots 24 farm the front surface thereof such that they are obscured by the bracket frame member 12. Those skilled in the art will recognize that either configuration is suitable in either instance. The use of four such extensions provides optimum rigidity in those instances wherein the distance between frame members is sufficient to require the use of extensions. The extensions 28 are preferably formed to have approximately the same thickness as the bracket frame member 12 and wing members 14 and 16**.

Alternatively, the tabs 26 may be sized to be larger at their distal most portions, i.e., mushroom shaped. They could then be inserted at an angle so that first one side, then the other, is installed in the slot 24.

Figure 4:
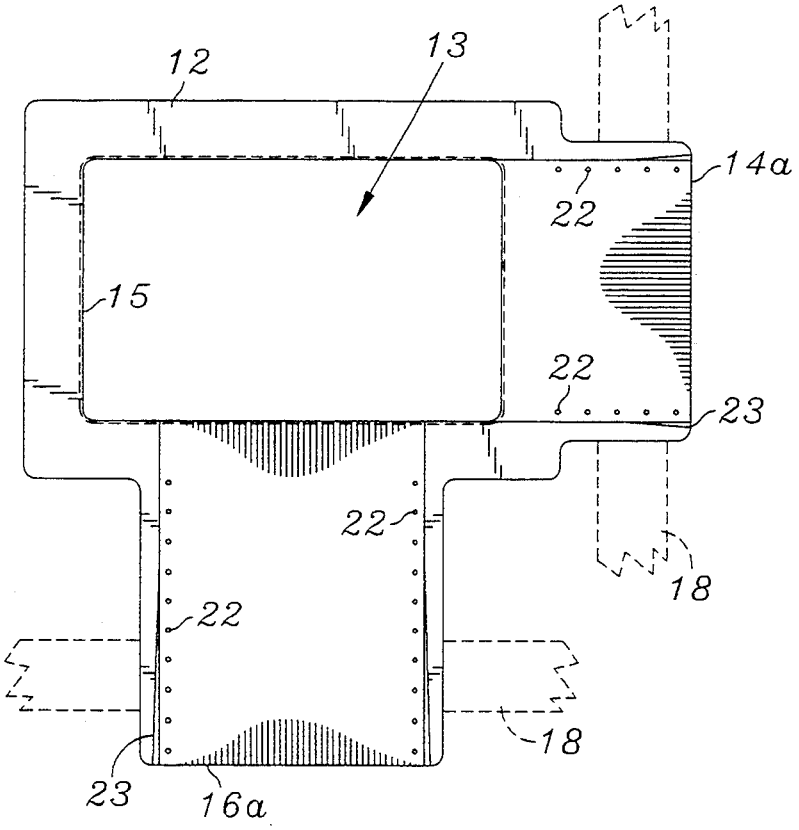
FIG. 4 is a top plan view of a second embodiment of the flat bracket for wall mount speakers of the present invention.

Referring now to FIG. 4, a second embodiment of the flat speaker bracket according to the present invention is illustrated. The first **14*a* and second 16*a* wing members extend perpendicularly from the bracket frame member 12 along adjacent sides thereof to facilitate attachment to perpendicular wall frame members 18** as may be found in corners.

Having described the structure of the flat speaker bracket of the present invention, it may be beneficial to describe the installation thereof. The flat speaker bracket 10 of the present invention is typically used in new construction installations wherein the studs or wall frame members 18 are exposed, i.e., the wallboard has not yet been applied thereto.

After choosing the appropriately configured frame bracket, i.e., one having either parallel or perpendicular extending wing members, the flat speaker bracket 10 is positioned such that the opening 13 therein is located where the installation of a speaker or speaker assembly is desired and such that the first 14 and second 16 wing members are positioned over adjacent wall frame members 18.

In those situations where the distance between adjacent wall frame members 18 is greater then the span of the wing members 14 and 16, optional extensions 28 are utilized. The optional extensions 28 are preferably attached to the first 14 and/or 16 wing members during manufacturing thereof via ultrasonic welding. Alternatively, the extensions 28 may be attached to the first 14 and/or second 16 wing members by the user during the installation process via chemical bonding, stapling, etc. Prior to such chemical bonding, stapling, etc., the tabs 26 at the extensions 28 are inserted into the slots 24 of the bracket frame members to facilitate proper positioning thereof. The wing members and/or extensions 28 are attached to the adjacent wall frame members 18 via fasteners, i.e., nails, screws, staples, etc. Those skilled in the art will recognize that various means are suitable for attaching the extensions 28 to the flat speaker bracket 10.

Having thus positioned the flat speaker bracket 10 as desired, a wallboard is applied thereover such that an opening formed in the wallboard aligns with the central opening 13 of the flat speaker bracket 10. The opening in the wallboard is preferably formed of sufficient size and configuration to provide access to the mounting apertures 20 of the bracket frame member 12. Alternatively, the apertures 20 may remain covered by the wallboard.

The speaker or speaker assembly (not shown) is attached to the flat speaker bracket by passing fasteners, i.e., screws, therethrough and into the apertures 20 of the bracket frame member 12. If the apertures 20 are obscured by the wallboard, the fasteners are first forced through the wallboard and then through the apertures 20 of the bracket frame member 12.

Tightening of the fasteners draws the speaker or speaker assembly and the bracket frame member together, thus sandwiching or capturing the wallboard therebetween to securely attach the speaker or speaker assembly to the wall, ceiling, or other architectural structure as desired.

As will be appreciated, the use of such a thin, i.e., having a thickness of less than 0.040 inch, speaker bracket eliminates the need to notch or mortise the wall frame members 18 prior to attachment of the bracket wing members 14 and/or 16, and/or the extensions 28 thereto such that bowing of the later applied wallboard is thereby mitigated.

The optional corrugations 23 formed in the first 14 and second 16 wing members and similar corrugations 25 formed in the extensions 28, if utilized, are flattened when the wallboard is applied to the frame members 18. Since the wing members 14 and 16 as well as any extensions 28 utilized are firmly captured intermediate the wallboard and wall frame members 18, the structural strength afforded by the corrugations 23 and 25 is no longer required. As such, no detrimental effect is realized by the flattening of the corrugations 23 and 26 during the installation process.

The present may alternatively be utilized as a template for mounting speakers and the like within walls and ceilings. To utilize the present invention as such as template, it is first attached to the wall or ceiling intermediate the studs and wallboard as discussed above. Then the speaker or other device is positioned within the opening 13 thereof, which serves as a guide to facilitate mounting at the correct position and orientation. Separate means are then utilized to secure the speaker or other device to the wall or ceiling.

It is understood that the exemplary flat brackets described herein and shown in the drawings represents only presently preferred embodiments of the invention, indeed various modifications and additions may be made to such embodiments without departing from the spirit and scope of the invention. For example, the corrugations may by configured differently from those shown and discussed and may additionally encompass the bracket frame member. Indeed, the entire bracket may be corrugated if desired.

Thus, these and other modifications and additions may be obvious to those skilled in the art and may be implemented to adapt the present invention for use in a variety of different applications.

What is claimed is:

1. A bracket for the in-wall mounting of speakers, said bracket comprising:

(a) a bracket frame member having a plurality of apertures formed therein for receiving fasteners to attach at least one speaker thereto;

(b) a plurality of wing members formed upon said bracket frame member for attaching said bracket frame member to a wall; and (c) wherein said bracket frame member and said wing members are formed having a thickness of less than 0.040 inch to facilitate attachment to the wall intermediate a wall frame member and wallboard such that bowing of the wallboard is mitigated.

2. The bracket as recited in claim 1 wherein said wing members further comprise corrugations formed therein to increase the strength thereof.

3. The bracket as recited in claim 1 wherein said bracket frame member and said wing members are formed of styrene.

4. The bracket as recited in claim 1 wherein said frame member and said wing members are integrally formed.

5. The bracket as recited in claim 1 wherein said frame member is generally rectangular in shape.

6. The bracket as recited in claim 1 wherein said wing members further comprise apertures for receiving fasteners to attach the bracket to a wall frame.

7. The bracket as recited in claim 1 wherein said plurality of wing members comprises two wing members.

8. The bracket as recited in claim 7 wherein said two wing members are attached to opposite sides of said frame members such that they are parallel to one another.

9. The bracket as recited in claim 7 wherein said two wing members are attached to said frame members such that they are perpendicular to one another.

10. The bracket as recited in claim 1 wherein said plurality of wing members comprises four wing members, adjacent wing members being formed perpendicular to one another.

11. A method for mounting speakers to a wall, said method comprising the steps of:

(a) attaching a bracket having a bracket frame member and a plurality of wing members to a wall frame, said bracket being formed of a sheet material and being less than 0.040 inch thick, said bracket frame member having an opening formed therein;
(b) applying wallboard over said bracket;
(c) forming an opening in said wallboard, the opening in said wallboard corresponding generally in configuration and position to the opening in the bracket frame member; and
(d) attaching at least one speaker to said bracket frame member.

12. The method as recited in claim 11 wherein the step at forming an opening in said wallboard is performed prior to the step of attaching the bracket to the frame member.

13. The method as recited in claim 11 wherein the step at forming an opening in said wallboard is performed subsequent to the step of attaching the bracket to the frame member.

14. The method as recited in claim 11 wherein said sheet material is less than 0.020 inch thick.

15. A method for mounting speakers to a wall, said method comprising the steps of:
(a) forming an opening in wallboard applied over wall frame members, said opening being sized to receive the speakers;
(b) manipulating a bracket having a bracket frame member and a plurality of wing members, said bracket being formed of a sheet material and being less than 0.040 inch thick, through said opening into said wall;
(c) manipulating at least one wing of said bracket intermediate the wallboard and a wall frame member such that said bracket is captured therebetween; and
(d) attaching at least one speaker to said bracket frame member,

16. A template for the in-wall mounting of speakers, said template comprising:
(a) a template frame member;
(b) a plurality of wing members formed upon said template frame member for attaching said template frame member to a wall; and
(c) wherein said template frame member and said wing members are formed having a thickness of less than 0.040 inch to facilitate attachment to the wall intermediate a wall frame member and wallboard such that bowing of the wallboard is mitigated.

17. The template as recited in claim 16 wherein said wing members further comprise corrugations formed therein to increase the strength thereof.

18. The template as recited in claim 16 wherein said template frame member and said wing members are formed of styrene.

19. The template as recited in claim 16 wherein said frame member and said wing members are integrally formed.

20. The template as recited in claim 16 wherein said frame member is generally rectangular in shape.

21. The template as recited in claim 16 wherein said wing members further comprise apertures for receiving fasteners to attach the template to a wall frame.

22. The template as recited in claim 16 wherein said plurality of wing members comprises two wing members.

23. The template as recited in claim 22 wherein said two wing members are attached to opposite sides of said frame members such that they are parallel to one another.

24. The template as recited in claim 22 wherein said two wing members are attached to said frame members such that they are perpendicular to one another.

25. The template as recited in claim 16 wherein said plurality of wing members comprises four wing members, adjacent wing members being formed perpendicular to one another.

26. A method for mounting speakers to a wall, said method comprising the steps of:
(a) attaching a template having a template frame member and a plurality of wing members to a wall frame, said template being formed of a sheet material and being less than 0.040 inch thick, said template frame member having an opening formed therein;
(b) applying wallboard over said template;
(c) forming an opening in said wallboard, the opening in sad wallboard corresponding generally in configuration and position to the opening in the template frame member: and
(d) positioning at least one speaker within the opening in said wallboard, said speaker(s) being reviewed within the template frame member.

27. The method as recited in claim 26 wherein the step at forming an opening in said wallboard is performed prior to the step of attaching the template to the frame member.

28. The method as recited in claim 26 wherein the step at forming an opening in said wallboard is performed subsequent to the step of attaching the template to the frame member.

29. The method as recited in claim 26 wherein said sheet material is less than 0.020 inch thick.

30. A method for mounting speakers to a wall, said method comprising the steps of:
(a) forming an opening in wallboard applied over wall frame members, said opening being sized to receive the speakers;
(b) manipulating a template having a template frame member and a plurality of wing members, said template being formed of a sheet material and being less than 0.040 inch thick, through said opening into said wall;
(c) manipulating at least one wing of said template intermediate the wallboard and a wall frame member such that said template is captured therebetween; and
(d) positioning at least one speaker within the template frame members.

* * * * *